US005948729A

United States Patent [19]

Landry-Coltrain et al.

[11] Patent Number: 5,948,729

[45] Date of Patent: Sep. 7, 1999

[54] THERMAL DYE TRANSFER RECEIVING ELEMENT

[75] Inventors: Christine J. T. Landry-Coltrain, Fairport; Kristine B. Lawrence, Rochester; Teh-Ming Kung, Rochester; Linda M. Franklin, Rochester, all of N.Y.

[73] Assignee: Eastman Kodak Company, Rochester, N.Y.

[21] Appl. No.: 09/062,119

[22] Filed: Apr. 17, 1998

[51] Int. Cl.[6] ..... B41M 5/035; B41M 5/38

[52] U.S. Cl. ..... 503/227; 428/195; 428/480; 428/484; 428/913; 428/914

[58] Field of Search ..... 8/471; 428/195, 428/480, 484, 913, 914; 503/227

[56] References Cited

U.S. PATENT DOCUMENTS

| | | | |
|---|---|---|---|
| 5,317,001 | 5/1994 | Daly et al. | 503/227 |
| 5,427,847 | 6/1995 | Zawada et al. | 428/331 |

*Primary Examiner*—Bruce Hess
*Attorney, Agent, or Firm*—Harold E. Cole

[57] ABSTRACT

A dye-receiving element for thermal dye transfer comprising a support having on one side thereof a dye image-receiving layer comprising a water-dispersible polyester having the following structure:

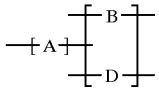

wherein:

A is the residue of one or more diol components which together comprise 100 mole % of recurring units B is the residue of a diacid component which comprises about 8 to 50 mole % of recurring units; and D is the residue of a diacid component which comprises 50 to 92 mole % of recurring units;

the dye image-receiving layer also containing a carnauba wax emulsion or dispersion in a wax:polyester ratio of about 1:200 to about 2:3.

18 Claims, No Drawings

THERMAL DYE TRANSFER RECEIVING ELEMENT

FIELD OF THE INVENTION

This invention relates to dye-receiving elements used in thermal dye transfer, and more particularly to polyester dye image-receiving layers for such elements.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements used in thermal dye transfer generally include a support (transparent or reflective) bearing on one side thereof a dye image-receiving layer, and optionally additional layers. The dye-receiving layer comprises a polymeric material chosen from a wide assortment of compositions and should have good affinity for the dye. Dyes must migrate rapidly into the layer during the transfer step and become immobile and stable in the viewing environment. One way to immobilize the dye in the receiving element is to transfer a laminate layer from the donor element to the receiver after the image has been generated. The dye-receiving layer must also not stick to the hot donor during the printing process, otherwise the final image will be damaged due to either the donor or receiver tearing while peeling apart after the printing step. One way to prevent donor-receiver sticking is to apply an overcoat layer or to add release agents to the receiver layer. The overcoat would require a separate coating step which increases manufacturing costs of the dye-receiving element and addition of release agents increases the media costs.

DESCRIPTION OF RELATED ART

U.S. Pat. No. 5,317,001 relates to thermal dye transfer to a receiver element. The dye-receiving layer is described as comprising a water-dispersible polyester. These materials are aqueous coatable and were found to provide good image-receiving layer polymers because of their effective dye-compatibility and receptivity. However, there is a problem with this material in that severe donor-receiver sticking occurs during the printing process.

U.S. Pat. No. 5,427,847 relates to the wax transfer of dyes to a receptor sheet. The receptor sheet comprises a mixture of a wax coating having a Tg below 25° C. and a polymeric material which is used in a wax transfer process, and not a thermal dye transfer process. In addition, the weight ratio of wax to polymer is described to be from 2:1 to 12:1, whereas the amount of wax in the receiving layer of the present invention is relatively small. While carnauba wax is disclosed in this reference, the preferred material is polyethylene wax, which is one of the control materials in the examples shown hereinafter which were less effective.

It is an object of this invention to provide a receiver element for thermal dye transfer processes with a dye image-receiving layer that is water-coatable. It is another object of the invention to provide a receiver element for thermal dye transfer processes which will not stick to the donor during the printing process. It is another object of the invention to provide a receiver element for the thermal dye transfer process that will give good uptake of the dye.

SUMMARY OF THE INVENTION

These and other objects are achieved in accordance with this invention which comprises a dye-receiving element for thermal dye transfer comprising a support having on one side thereof a dye image-receiving layer comprising a water-dispersible polyester having the following structure:

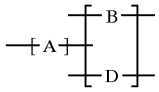

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % of recurring units and is represented by one or more of the following structures:

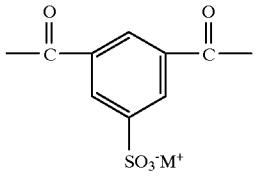

-continued

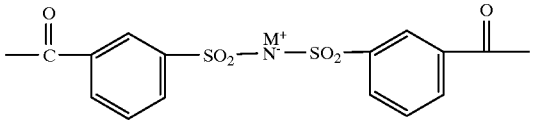

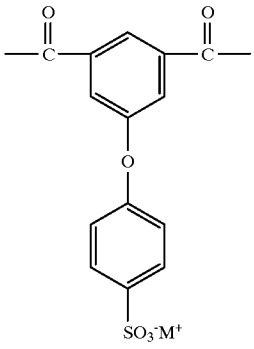

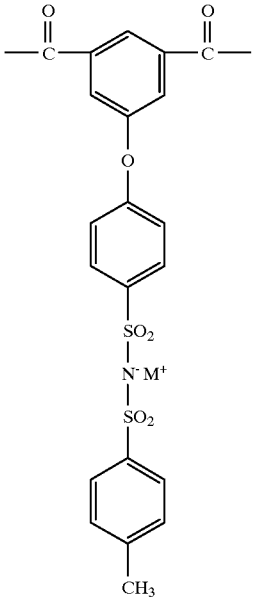

wherein $M^+$ represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

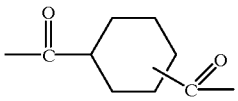

or

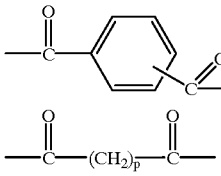

where p represents an integer from 2 to 10;

the dye image-receiving layer also containing a carnauba wax emulsion or dispersion in a wax:polyester ratio of about 1:200 to about 2:3, preferably from about 1:50 to about 1:3.

DESCRIPTION OF THE PREFERRED EMBODIMENTS

The polyester employed in the invention preferably has a Tg between about −50° C. and 100° C. Higher Tg polyesters may be used if a plasticizer is added. In a preferred embodiment of the invention, the polyester has a number average molecular weight of from about 10,000 to about 250,000, more preferably from 20,000 to 100,000.

Examples of polyesters used in the invention include the following:

P-1 poly[cis/trans-1,4-cyclohexanedicarboxylic acid-co-5-sulfoisophthalic acid, sodium salt (84:16 molar ratio)-trans 1,4-cyclohexanedimethanol (100 molar ratio)], Mw=25,700, Tg=54° C.

P-2 poly[cis/trans-1,4-cyclohexanedicarboxylic acid-co-5-sulfoisophthalic acid, sodium salt (84:16 molar ratio)-trans 1,4-cyclohexanedimethanol-co-tripropylene glycol (92:8 molar ratio)], Mw=28,600, Tg=62 ° C.

P-3 poly[cis/trans-1,4-cyclohexanedicarboxylic acid-co-5-sulfoisophthalic acid, sodium salt (84:16 molar ratio)-trans 1,4-cyclohexanedimethanol-co-octane diol (76:24 molar ratio)], Mw=45,500, Tg=20 ° C.

P-4 poly[cis/trans-1,4-cyclohexanedicarboxylic acid-co-5-sulfoisophthalic acid, sodium salt (84:16 molar ratio)-trans 1,4-cyclohexanedimethanol-co-decane diol (94:6 molar ratio)], Mw=11,900, Tg=49° C.

P-5 poly[isophthalic acid-co-5-sulfoisophthalic acid (90:10 molar ratio)-diethylene glycol (100 molar ratio)], Mw=20,000 (sulfonic acid of AQ29D®, Eastman Chemical Co.), Tg=28° C.

P-6 poly[isophthalic acid-co-5-sulfoisophthalic acid, ammonium salt (90:10 molar ratio)-diethylene glycol (100 molar ratio)], Mw=20,000, Tg=28° C.

The synthesis of the aqueous dispersible polyesters is analogous to the procedure described in U.S. Pat. No. 5,317,001, the disclosure of which is hereby incorporated by reference.

The polyester employed in the invention may be used alone or in combination with other polymers having no or slight acidity. These other polymers include condensation polymers such as polyesters, polyurethanes, polycarbonates, etc.; addition polymers such as polystyrenes, vinyl polymers, acrylic polymers, etc.; or block copolymers containing large segments of more than one type of polymer covalently linked together. In a preferred embodiment of the invention, an acrylic polymer, a styrene polymer or a vinyl polymer having a Tg of less than 19° C. is used. These polymers may be employed at a concentration ranging from about 0.5 g/m$^2$ to about 10 g/m$^2$ and may be coated from organic solvents or water, if desired.

Examples of such other polymers include the following:

Polymer A: poly(butyl acrylate-co-allyl methacrylate) 98:2 wt core/poly(glycidyl methacrylate) 10 wt shell, (Tg=−40° C.)

Polymer B: poly(butyl acrylate-co-allyl methacrylate) 98:2 wt core/poly(ethyl methacrylate) 30 wt shell, (Tg=−41° C.)

Polymer C: poly(butyl acrylate-co-allyl methacrylate) 98:2 wt core/poly(2-hydroxypropyl methacrylate) 10 wt shell, (Tg=−40° C.)

Polymer D: poly(butyl acrylate-co-ethylene glycol dimethacrylate) 98:2 wt core/poly(glycidyl methacrylate 10 wt shell, Tg=−42° C.)

Polymer E: poly(butyl acrylate-co-allyl methacrylate-co-glycidyl methacrylate) 89:2:9 wt, (Tg=−34° C.)

Polymer F: poly(butyl acrylate-co-ethylene glycol dimethacrylate-co-glycidyl methacrylate) 89:2:9 wt (Tg=−28° C.)

Polymer G: poly(butyl methacrylate-co-butyl acrylate-co-allyl methacrylate) 49:49:2 wt core/poly(glycidyl methacrylate) 10 wt shell, (Tg=−18° C.)

Polymer H: poly(methyl methacrylate-co-butyl acrylate-co-2-hydroxyethyl methacrylate-co-2-sulfoethyl methacrylate, sodium salt) 30:50:10:10 wt, (Tg=−3° C.)

Polymer I: poly(methyl methacrylate-co-butyl acrylate-co-2-hydroxyethyl methacrylate-co-styrenesulfonic acid, sodium salt) 40:40:10:10 wt, (Tg=0C.)

Polymer J: poly(methyl methacrylate-co-butyl acrylate-co-2-sulfoethyl methacrylate sodium salt-co-ethylene glycol dimethacrylate) 44:44:10:2 wt, (Tg=14° C.)

Polymer K: poly(butyl acrylate-co-Zonyl TM®-co-2-acrylamido-2-methyl-propanesulfonic acid, sodium salt) 50:45:5 wt (Tg=−39° C.) (Zonyl TM® is a monomer from the DuPont Company)

Polymer L: XU31066.50 (experimental polymer based on a styrene butadiene copolymer from Dow Chemical Company) (Tg=−31° C.)

The polyester employed in the dye image-receiving layer of the invention may be present in any amount which is effective for its intended purpose. In general, good results have been obtained at a concentration of from about 0.5 to about 10 g/m$^2$.

Wax dispersions/emulsions useful in the invention include: carnauba wax; mixtures of carnauba wax with other waxes such as polyethylene (PE); high density polyethylene (HDPE); polytetrafluoroethylene (PTFE); fluorinated ethylene propylene (FEP) and polymeric waxes. Specific examples useful in the invention include the following:

| Wax ID | Wax Dispersion or Emulsion Description | Wax Type Particle Size (μm) | Manufacturer |
|---|---|---|---|
| W-1 | ML160 | Carnauba (0.1) | Michelman Inc. |
| W-2 | ME64540 | Carnauba (0.3) | " |
| W-3 | CC FG#3 | Carnauba (0.08) | Chemical Corporation of America |
| W-4 | CC 36A | carnauba/paraffin (0.17) | Chemical Corporation of America |
| W-5 | Slip-Ayd SL 535E® | Carnauba (<1.0) | Daniel Products Co. |
| W-6 | Slip-Ayd SL 535E® | Carnauba (<1.0) | Daniel Products Co |
| | Slip-Ayd SL 340E® | PE (<1.0) | " |
| | Slip-Ayd SL 512® | hard polymeric (1.0–3.0) | " |

The support for the dye-receiving element of the invention may be transparent or reflective, and may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., 10 may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965,241, the disclosures of which are incorporated by reference. The receiver element may also include a backing layer such as those disclosed in U.S. Pat. Nos. 5,011,814 and 5,096,875, the disclosures of which are incorporated by reference.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. Alternatively, other known sources of energy for thermal dye transfer may be used, such as lasers as described in, for example, GB 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLES

Example 1

The following dyes were used in the experimental work:

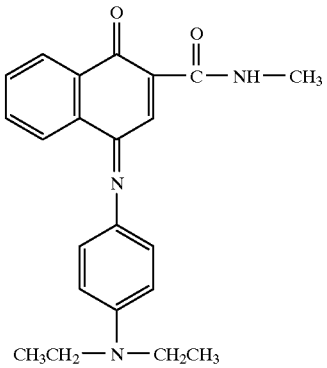

Cyan Dye 1

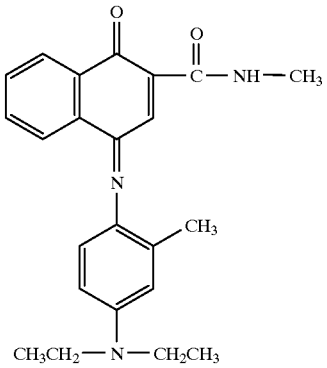

Cyan Dye 2

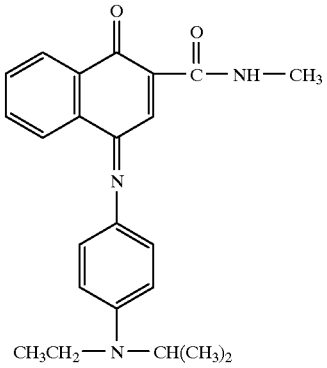

Cyan Dye 3

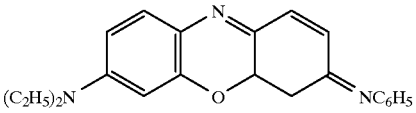

Cyan Dye 4

-continued

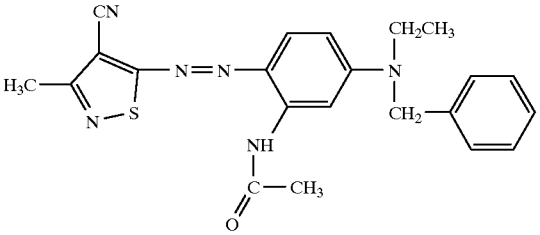

Magenta Dye 1

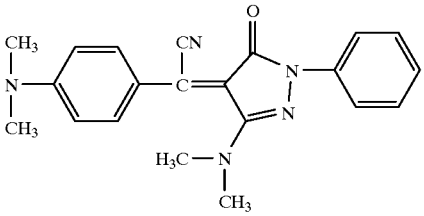

Magenta Dye 2

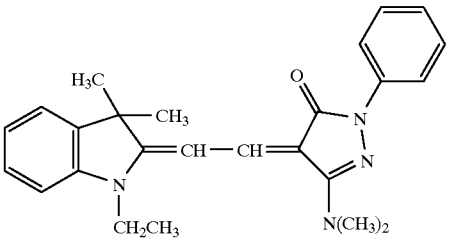

Yellow Dye 1

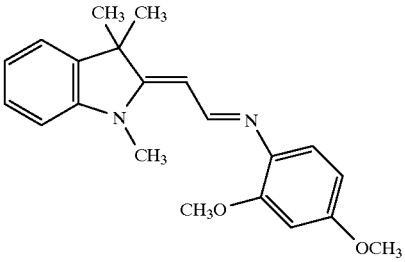

Yellow Dye 2

The following control wax dispersions were used in the examples:

| Wax ID | Wax Dispersion or Emulsion Description | Wax Type Particle Size (μm) | Manufacturer |
|---|---|---|---|
| CW-1 | ME 02925 | PE (0.05) | Michelman Inc. |
| CW-2 | CC316N30A | HDPE (0.09) | Chemical Corporation of America |
| CW-3 | CC392AS25 | HDPE (0.15) | Chemical Corporation of America |
| CW-4 | ME 72040 | polyolefin E2 (0.2) | Michelman Inc. |
| CW-5 | Chemslip 42® | PTFE (>1.0) | Chemical Corporation of America |
| CW-6 | FEP-T120 | FEP (0.2) | DuPont |
| CW-7 | AD-1 | PTPE (0.2) | ICI Fluoropolymers |
| CW-8 | Teflon-PTFE30® | PTFE (0.05–0.5) | DuPont |

Control Receiver Element C-1:

This element was prepared by first extrusion-laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of 0.02 g/m$^2$ Polymin P® polyethyleneimine (BASF Corporation) coated from distilled water 2) and a dye-receiving layer composed of a mixture of 3.23 g/m$^2$ of polyester P-1 and 0.022 g/m$^2$ of a fluorocarbon surfactant (Fluorad FC-170C®, 3M Corporation), coated from distilled water.

Receiver Elements E-1 through E-4 of the invention and Control Receiver Elements C-2 through C-9:

These were prepared the same as Control Receiver Element C-1, except the dye image-receiving layer was a mixture of 2.58 g/m$^2$ of polyester P- 1, 0.65 g/m$^2$ of wax emulsion/dispersions W-1 through W-4 or control wax emulsion/dispersions CW-1 through CW-8 and 0.022 g/m$^2$ of a fluorocarbon surfactant (Fluorad FC-170C®, 3M Corporation), coated from distilled water.

Preparation of Dye Donor Elements:

Dye-donor elements were prepared by coating on a 6 μm poly(ethylene terephthalate) support (DuPont Co.):

1) a subbing layer of titanium tetra-n-butoxide (Tyzor TBT®, DuPont Co.) (0.12 g/m$^2$) from a n-propyl acetate/1-butanol (85/15) solvent mixture, and 2) repeating yellow, magenta and cyan dye patches containing the compositions as described below.

The yellow composition contained 0.29 g/m$^2$ of Yellow Dye 1, 0.31 g/m$^2$ of CAP 482-20 (20 s viscosity cellulose acetate propionate, Eastman Chemical Co.), 0.076 g/m$^2$ of CAP 482-0.5 (0.5 s viscosity cellulose acetate propionate, Eastman Chemical Co.), 0.006 g/m$^2$ of 2 μm divinylbenzene crosslinked beads Eastman Kodak Co.), and 0.0014 g/m$^2$ of Fluorad FC-430® (3M Corporation) from a toluene/methanol/cylcopentanone solvent mixture (70/25/5).

The magenta composition contained 0.17 g/m$^2$ of Magenta Dye 1, 0.18 g/m$^2$ of Magenta Dye 2, 0.31 g/m$^2$ of CAP 482-20, 0.07 g/m$^2$ of 2,4,6-trimethylanilide of phenylindan-diacid, 0.006 g/m$^2$ of 2 μm divinylbenzene crosslinked beads and 0.0011 g/m$^2$ of Fluorad FC-430® from a toluene/methanol/cylcopentanone solvent mixture (70/25/5).

The cyan composition contained 0.14 g/m$^2$ of Cyan Dye 1, 0.12 g/m$^2$ of Cyan Dye 2, 0.29 g/m$^2$ of Cyan Dye 3, 0.31 g/m$^2$ of CAP 482-20, 0.02 g/m$^2$ of CAP 482-0.5, 0.01 g/m$^2$ of 2 μm divinylbenzene crosslinked beads and 0.0007 g/m$^2$ of Fluorad FC-430® from a toluene/methanol/cylcopentanone solvent mixture (70/25/5).

On the backside of the donor element were coated the following layers in sequence:

1) a subbing layer of titanium tetra-n-butoxide (Tyzor TBT®, DuPont Co.) (0.12 g/m$^2$) from a n-propyl acetate/1-butanol (85/15) solvent mixture, and 2) a slipping layer containing 0.38g/m$^2$ poly(vinyl acetal) (Sekisui Co.), 0.022 g/m$^2$ Candelilla wax dispersion (7% in methanol), 0.011 g/m$^2$ PS513 aminopropyl-dimethyl-terminated polydimethylsiloxane (Huels) and 0.003 g/m$^2$ p-toluenesulfonic acid coated from 3-pentanone (98%)/distilled water (2%) solvent mixture.

Preparation and Evaluation of Thermal Dye Transfer Images

Eleven-step sensitometric full color (yellow+magenta+cyan) thermal dye transfer image s were prepared from the above dye-donor and dye-receiver elements. The dye side of the dye-donor element, approximately 10 cm×15 cm in area, was placed in contact with a receiving-layer side of a dye-receiving element of the same area. This assemblage was clamped to a stepper motor-driven, 60 mm diameter rubber roller. A thermal head (TDK No. 8F10980, thermostatted at 25° C.) was pressed with a force of 24.4 Newton (2.5 kg) against the dye-donor element side of the assemblage, pushing it against the rubber roller.

The imaging electronics were activated causing the donor-receiver assemblage to be drawn through the printing head/roller nip at 40.3 mm/sec. Coincidentally, the resistive elements in the thermal print head were pulsed for 127.75 μs/pulse at 130.75 μs intervals during a 4.575 ms/dot printing cycle (including a 0.391 ms/dot cool down interval). A stepped image density was generated by incrementally increasing the number of pulses/dot from a minimum of 0 to a maximum of 32 pulses/dot. The voltage supplied to the thermal head was approximately 14.0 v resulting in an instantaneous peak power of 0.369 watts/dot and a maximum total energy of 1.51 mJ/dot; print room humidity: 50–57% RH.

The above printing procedure was done using the yellow, magenta and cyan dye-donor patches. When properly registered, a full color image was obtained. During the printing process, the level of donor-to-receiver sticking was determined visually and rank ordered. A 0 indicates no donor-receiver sticking was observed, a 3 indicates medium levels of sticking and a 5 indicates severe sticking.

Where applicable, the level of tackiness for each print was determined by ranking each image according to how tacky the print feels upon touch. A 1 indicates no tackiness and a 2 indicates tackiness. The results are summarized in the following Table 1:

TABLE 1

| Element | Wax ID | Stick Ranking |
|---|---|---|
| E-1 | W-1 | 2 |
| E-2 | W-2 | 1 |
| E-3 | W-3 | 0 |
| E-4 | W-4 | 1 |
| C-1 | none | 4 |
| C-2 | CW-1 | 4 |
| C-3 | CW-2 | 4 |
| C-4 | CW-3 | 3 |
| C-5 | CW-4 | 4 |
| C-6 | CW-5 | 4 |
| C-7 | CW-6 | 3 |
| C-8 | CW-7 | 3 |
| C-9 | CW-8 | 3 |

The above results show that incorporation of emulsions or dispersions containing carnauba wax (W-1 through W-4) to an aqueous dispersible polyester (E-1 through E4) significantly reduced the amount of donor-to-receiver sticking relative to the receiver element that did not contain these waxes (C-1) or to receiver elements that contained wax emulsions or dispersions that did not contain carnauba wax (C-2 through C-9).

Example 2

Control Receiver Elements C-10 through C-12:

These elements were prepared as described for Control Receiver Element C-1 in Example 1, except polymers P-2 through P-4 were used in place of P-1 (no wax was added).

Receiver Elements E-5 through E-7:

These elements were prepared as described for Receiver Elements E-1 through E4 in Example 1, except polymers P-2 through P-4 were used in place of polymer P-1 and 0.65 g/m$^2$ of W-1 was used as the wax emulsion/dispersion.

Thermal dye transfer prints were prepared using Receiver Elements E-5 through E-7 and Control Receiver Elements C-10 through C-12 and evaluated as described in Example 1 and the results are summarized in Table 2 below.

TABLE 2

| Element | Polymer ID | Wax ID | Stick Ranking |
|---|---|---|---|
| E-5 | P-2 | W-1 | 1 |
| E-6 | P-3 | W-1 | 1 |
| E-7 | P-4 | W-1 | 1 |
| C-1 | P-1 | no wax | 4 |
| C-10 | P-2 | no wax | 3 |
| C-11 | P-3 | no wax | 2 |
| C-12 | P-4 | no wax | 3 |

The above results show that incorporation of an emulsion or dispersion containing carnauba wax (W-1) to a variety of aqueous dispersible polyester coatings (E-5 through E-7) significantly reduced the amount of donor-to-receiver sticking relative to the corresponding polyester coatings that did not contain the wax (C-1, and C-10 through C-12).

Example 3

Control Receiver Element C-13:

This element was prepared as described for Control Receiver Element C-1 in Example 1, except the subbing layer was a mixture of Prosil® 221 (aminopropyl triethoxysilane) and 2210 (an aminofunctional epoxysilane) (0.05 g/m$^2$ each), (both available from PCR, Inc.) coated from 3A alcohol, and the dye receiving layer was composed of a mixture of 2.37 g/m$^2$ of polyester P-5 and 3.55 g/m$^2$ of polymer A, coated from distilled water.

Receiver Elements E-8 through E-11

These elements were prepared as described above for Control Receiver Element C-13, except the dye receiving layer contained mixtures of polyester P-5, polymer P-7, and an aqueous dispersion/emulsion of carnauba wax, W- 1. The amounts each component used can be found in Table 3 below.

TABLE 3

| Receiver Element | P-5 (g/m$^2$) | P-7 (g/m$^2$) | W-1 (g/m$^2$) |
|---|---|---|---|
| E-8 | 2.37 | 3.43 | 0.12 |
| E-9 | 2.37 | 2.96 | 0.33 |
| E-10 | 2.37 | 2.66 | 0.89 |
| E-11 | 2.37 | 2.37 | 1.18 |
| C-13 | 2.37 | 2.37 | 0 |

Dye-Donor Elements:

These elements were prepared as described in Example 1 except the dye imaging layers used were composed of mixtures of Yellow Dye 2 or Cyan Dye 4, propionate ester of bisphenol A copolymer with epichlorohydrin, DB-1 (prepared by techniques similar to those described in U.S. Pat. No. 5,244,862) and poly(butyl methacrylate-co-Zonyl TM®) (75/25), DB-2 where Zonyl TM® is a perfluoro monomer available from DuPont coated from a tetrahydrofuran/cylopentanone (95/5) solvent mixture. Details of the dye and binder laydowns are summarized in the following Table 4:

TABLE 4

| Dye Donor Element | Dye Laydown (g/m$^2$) | DB-1 Laydown (g/m$^2$) | DB-2 Laydown (g/m$^2$) |
|---|---|---|---|
| Yellow Dye 2 | 0.28 | 0.27 | 0.07 |
| Cyan Dye 4 | 0.15 | 0.17 | 0.06 |

Thermal dye transfer prints were prepared using Receiver Elements E-8 through E-11 and Control Receiver Element C-13 and evaluated as described in Example 1 except only yellow and cyan images were generated and the print voltage was 12.5 volts resulting in an instantaneous peak power of 0.294 watts/dot and a maximum total energy of 1.20 mJ/dot. The results may be found in the following Table 5:

TABLE 5

| Receiver Element | W-1 (g/m$^2$) | Stick Ranking | Tackiness Ranking |
|---|---|---|---|
| E-8 | 0.12 | 1 | 1 |
| E-9 | 0.33 | 0 | 1 |
| E-10 | 0.89 | 0 | 1 |
| E-11 | 1.18 | 0 | 1 |
| C-13 | no wax | 2 | 2 |

The above results show that incorporation of an emulsion or dispersion containing carnauba wax (W-1) at various levels with a mixture of an aqueous dispersible polyester, P-5 and polymer A (E-8 through E-11) significantly reduced the amount of donor-receiver sticking and tackiness relative to the coating that did not contain the carnauba wax (C-13).

Example 4

Control Receiver Element C-14

This element was prepared as described for Control Receiver Element C-13 except the dye receiving layer was composed of a mixture of 2.42 g/m$^2$ of acid source P-6, 3.40 g/m$^2$ of polymer A, 0.10 g/m$^2$ of succinic acid and 0.13 g/m$^2$ of 10 $\mu$m styrene butylacrylate divinylbenzene (40/40/20 wt ratio) beads (no wax added), coated from distilled water.

Receiver Element E-12

This element was prepared as described for Control Receiver Element C-14 except the dye receiving layer was composed of 2.42 g/m$^2$ of acid source P-6, 2.74 g/m$^2$ of polymer A, 0.10 g/m$^2$ of succinic acid, 0.13 g/m$^2$ of 10 $\mu$m styrene butylacrylate divinylbenzene (40/40/20 wt ratio) beads, and 0.66 g/m$^2$ carnauba wax, W-5.

Receiver Element E-13

This element was prepared as described for Receiver Element E-12 except the wax used was a mixture of 0.22 g/m$^2$ carnauba wax (W-5, Daniel Products Co.), 0.22 g/m$^2$ of Slip-Ayd SL 512® hard polymeric wax (Daniel Products, Co.), and 0.22 g/m$^2$ of Slip-Ayd SL 340E® polyethylene wax (Daniel Products, Co.).

Preparation and Evaluation of Thermal Dye Transfer Images

A uniform 20 cm×25 cm cyan patch image (Ca. OD=2.0) was made in a Kodak ColorEase® PS print engine using the cyan donor in Example 3 and the receiver elements described above. The voltage supplied to the thermal print head was adjusted to 12.0 volts. The resistive elements in the thermal print head were pulsed for 60.35 microsec/pulse in a 5 msec/line printing cycle. The initial thermal print head temperature was set at 36° C. and the print room temperature and humidity were 21° C. and 50% RH respectively.

During the cyan patch printing process, the degree of donor-receiver sticking was determined visually and rank ordered. The following results were obtained:

TABLE 6

| Element | Wax ID | Stick Ranking |
|---|---|---|
| E-12 | W-5 | 0 |
| E-13 | W-6* | 3 |
| C-14 | no wax | 5 |

*wax mixture was carnauba, polyethylene and polymeric waxes

The above results show that the addition of a carnauba wax (E-12) or a wax mixture where at least one of the components present is a carnauba wax (E-13) to the receiver element improved the donor-receiver sticking during printing relative to the element that did not contain a carnauba wax (C-14).

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer comprising a water-dispersible polyester having the following structure:

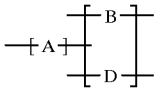

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % of recurring units and is represented by one or more of the following structures:

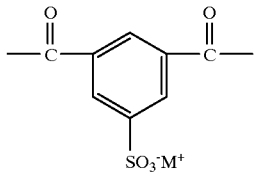

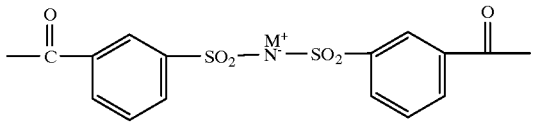

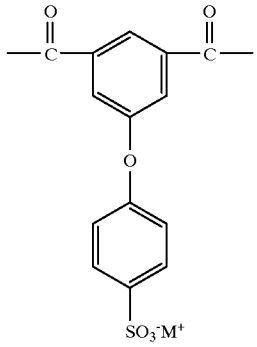

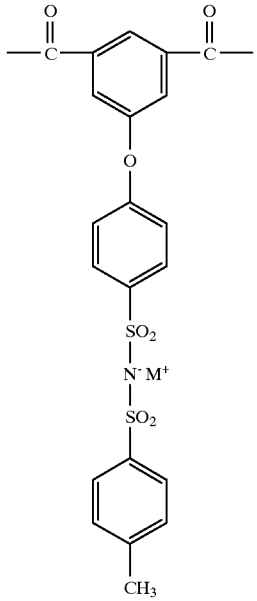

wherein $M^+$ represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

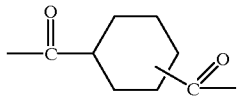

-continued

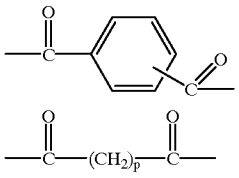

or where p represents an integer from 2 to 10;

said dye image-receiving layer also containing a carnauba wax emulsion or dispersion in a wax:polyester ratio of about 1:200 to about 2:3.

2. The element of claim 1 wherein said wax:polyester ratio is from about 1:50 to about 1:3.

3. The element of claim 1 wherein B is

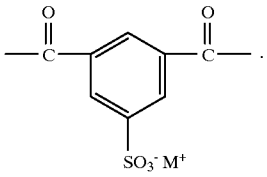

4. The element of claim 1 wherein said carnauba wax emulsion or dispersion contains a wax other than carnauba wax.

5. The element of claim I wherein said water-dispersible polyester is poly[cis/trans-1,4-cyclohexanedicarboxylic acid-co-5-sulfoisophthalic acid, sodium salt (84:16 molar ratio)-trans 1,4-cyclohexanedimethanol (100 molar ratio)].

6. The element of claim 1 wherein said water-dispersible polyester is poly[cis/trans-1,4-cyclohexanedicarboxylic acid-co-5-sulfoisophthalic acid, sodium salt (84:16 molar ratio)-trans 1,4-cyclohexanedimethanol-co-tripropylene glycol (92:8 molar ratio)].

7. The element of claim 1 wherein said water-dispersible polyester is poly[cis/trans- 1,4cyclohexanedicarboxylic acid-co-5-sulfoisophthalic acid, sodium salt (84:16 molar ratio) -trans 1,4-cyclohexanedimethanol-co-octane diol (76:24 molar ratio)].

8. The element of claim 1 wherein said water-dispersible polyester is poly[cis/trans-1,4-cyclohexanedicarboxylic acid-co-5-sulfoisophthalic acid, sodium salt (84:16 molar ratio)-trans 1,4-cyclohexanedimethanol-co-decane diol (94:6 molar ratio)].

9. The element of claim 1 wherein said water-dispersible polyester is poly[isophthalic acid-co-5-sulfoisophthalic acid (90:10 molar ratio)-diethylene glycol (100 molar ratio)].

10. The element of claim 1 wherein said water-dispersible polyester is poly[isophthalic acid-co-5-sulfoisophthalic acid, ammonium salt (90:10 molar ratio)-diethylene glycol (100 molar ratio)].

11. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer comprising a water-dispersible polyester having the following structure:

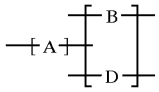

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % of recurring units and is represented by one or more of the following structures:

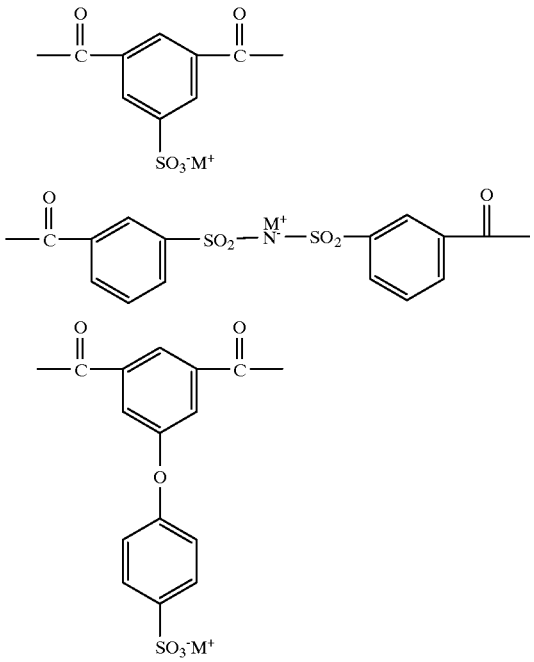

-continued

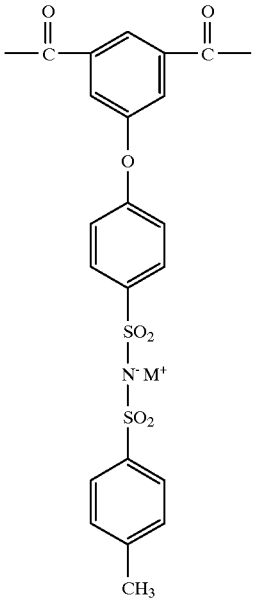

wherein $M^+$ represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

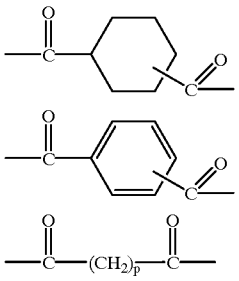

or where p represents an integer from 2 to 10;

said dye image-receiving layer also containing a carnauba wax emulsion or dispersion in a wax:polyester ratio of about 1:200 to about 2:3.

12. The process of claim 11 wherein said wax:polyester ratio is from about 1:50 to about 1:3.

13. The process of claim 11 wherein B is

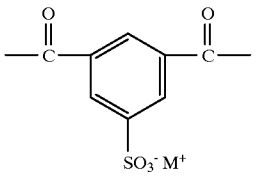

.

14. The process of claim 11 wherein said carnauba wax emulsion or dispersion contains a wax other than carnauba wax.

15. A thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer comprises a water-dispersible polyester having the following structure:

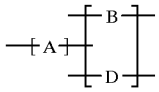

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % of recurring units and is represented by one or more of the following structures:

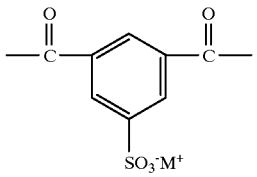

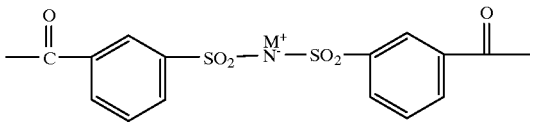

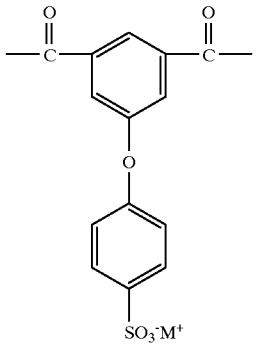

-continued

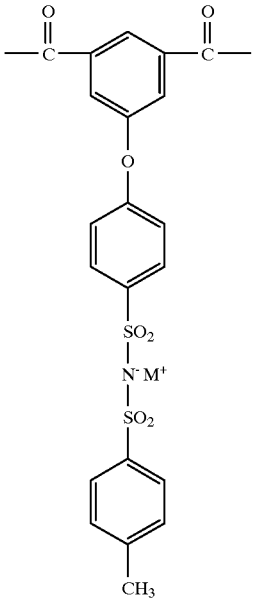

wherein $M^+$ represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

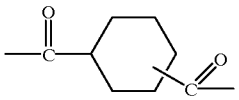

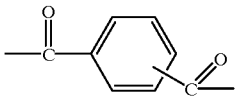

or

-continued

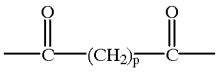

where p represents an integer from 2 to 10;

said dye image-receiving layer also containing a carnauba wax emulsion or dispersion in a wax:polyester ratio of about 1:200 to about 2:3.

16. The assemblage of claim 15 wherein said wax:polyester ratio is from about 1:50 to about 1:3.

17. The assemblage of claim 15 wherein B is

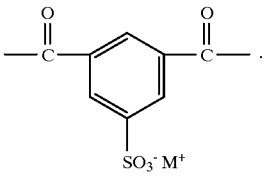

18. The assemblage of claim 15 wherein said carnauba wax emulsion or dispersion contains a wax other than carnauba wax.

* * * * *